US012031723B2

(12) United States Patent
Tokuyama et al.

(10) Patent No.: US 12,031,723 B2
(45) Date of Patent: Jul. 9, 2024

(54) PERFORATED PLATE FOR GAS TURBINE COMBUSTOR, GAS TURBINE COMBUSTOR, AND GAS TURBINE

(71) Applicant: MITSUBISHI HEAVY INDUSTRIES, LTD., Tokyo (JP)

(72) Inventors: Kentaro Tokuyama, Kanagawa (JP); Kenta Taniguchi, Kanagawa (JP); Toshinobu Ohara, Kanagawa (JP); Masaki Ono, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 18/020,155

(22) PCT Filed: Aug. 31, 2021

(86) PCT No.: PCT/JP2021/031895
§ 371 (c)(1),
(2) Date: Feb. 7, 2023

(87) PCT Pub. No.: WO2022/050259
PCT Pub. Date: Mar. 10, 2022

(65) Prior Publication Data

US 2023/0288068 A1 Sep. 14, 2023

(30) Foreign Application Priority Data

Sep. 4, 2020 (JP) ..... 2020-149132

(51) Int. Cl.
*F23R 3/26* (2006.01)

(52) U.S. Cl.
CPC ..... *F23R 3/26* (2013.01)

(58) Field of Classification Search
CPC ..... F23R 3/04; F23R 3/10; F23R 3/16; F23R 3/26; F23R 3/50; F23R 3/54; F23R 3/286; F23D 2900/11402
See application file for complete search history.

(56) References Cited

U.S. PATENT DOCUMENTS

2007/0199326 A1* 8/2007 Tanimura ..... F23R 3/04 60/740
2010/0275601 A1* 11/2010 Berry ..... F23R 3/04 60/737

(Continued)

FOREIGN PATENT DOCUMENTS

JP 2012-154587 8/2012
JP 2012-154588 8/2012

(Continued)

OTHER PUBLICATIONS

International Search Report issued Sep. 28, 2021 in International Application No. PCT/JP2021/031895.

*Primary Examiner* — David P. Olynick
(74) *Attorney, Agent, or Firm* — Wenderoth, Lind & Ponack, L.L.P.

(57) ABSTRACT

A perforated plate for a gas turbine combustor according to at least one embodiment is a perforated plate provided between a combustor basket and a combustor casing of the gas turbine combustor and fixed to an outer peripheral portion of the combustor basket. In a hole arrangement area with a plurality of through holes of the perforated plate, a region close to the combustor basket has a larger average value of a ligament ratio than a region close to the combustor casing, where the ligament ratio is obtained by dividing a distance between outer peripheral edges of two adjacent holes of the plurality of through holes by a distance between centers of the two holes.

11 Claims, 13 Drawing Sheets

(56) References Cited

U.S. PATENT DOCUMENTS

| | | | | |
|---|---|---|---|---|
| 2012/0045725 | A1* | 2/2012 | Takiguchi | F23R 3/16<br>431/60 |
| 2016/0377290 | A1 | 12/2016 | Okazaki et al. | |
| 2017/0198912 | A1* | 7/2017 | Thackway | F23R 3/06 |
| 2019/0277502 | A1 | 9/2019 | Shershnyov et al. | |

FOREIGN PATENT DOCUMENTS

| | | |
|---|---|---|
| JP | 2013-217267 | 10/2013 |
| JP | 2017-9262 | 1/2017 |
| WO | 2015/182727 | 12/2015 |

* cited by examiner

VIEW A-A

VIEW A-A

PERFORATED PLATE FOR GAS TURBINE COMBUSTOR, GAS TURBINE COMBUSTOR, AND GAS TURBINE

TECHNICAL FIELD

The present disclosure relates to a perforated plate for a gas turbine combustor, a gas turbine combustor, and a gas turbine.

The present application claims priority based on Japanese Patent Application No. 2020-149132 filed on Sep. 4, 2020, the entire content of which is incorporated herein by reference.

BACKGROUND ART

In a gas turbine combustor, a flow conditioning plate (perforated metal) is often placed between a combustor basket and a combustor casing of the gas turbine combustor to suppress unbalanced air flow in the gas turbine combustor (see Patent Document 1, for example).

CITATION LIST

Patent Literature

Patent Document 1: JP2017-9262A

SUMMARY

Problems to be Solved

For example, when the flow conditioning plate is welded and fixed to the combustor basket of the gas turbine combustor, the flow conditioning plate oscillates due to combustion oscillation during operation, and a large stress acts on the fixed portion of the flow conditioning plate on the combustor basket side. This may cause deformation of the flow conditioning plate or damage such that holes of the flow conditioning plate are connected to each other.

In view of the above, an object of at least one embodiment of the present disclosure is to suppress deformation or damage of a flow conditioning plate provided between a combustor basket and a combustor casing of a gas turbine combustor.

Solution to the Problems (1) A perforated plate for a gas turbine combustor according to at least one embodiment of the present disclosure is a perforated plate provided between a combustor basket and a combustor casing of the gas turbine combustor and fixed to an outer peripheral portion of the combustor basket. In a hole arrangement area with a plurality of through holes of the perforated plate, a region close to the combustor basket has a larger average value of a ligament ratio than a region close to the combustor casing, where the ligament ratio is obtained by dividing a distance between outer peripheral edges of two adjacent holes of the plurality of through holes by a distance between centers of the two holes.

(2) A gas turbine combustor according to at least one embodiment of the present disclosure is provided with the perforated plate having the above configuration (1).

(3) A gas turbine according to at least one embodiment of the present disclosure is provided with the gas turbine combustor having the above configuration (2).

Advantageous Effects

According to at least one embodiment of the present disclosure, it is possible to suppress deformation or damage of a flow conditioning plate provided between a combustor basket and a combustor casing of a gas turbine combustor.

DETAILED DESCRIPTION

Embodiments of the present disclosure will be described below with reference to the accompanying drawings. It is intended, however, that unless particularly identified, dimensions, materials, shapes, relative positions, and the like of components described in the embodiments shall be interpreted as illustrative only and not intended to limit the scope of the present disclosure.

For instance, an expression of relative or absolute arrangement such as "in a direction", "along a direction". "parallel". "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have". "contain" and "constitute" are not intended to be exclusive of other components.

(Gas Turbine 1)

Figure 1:
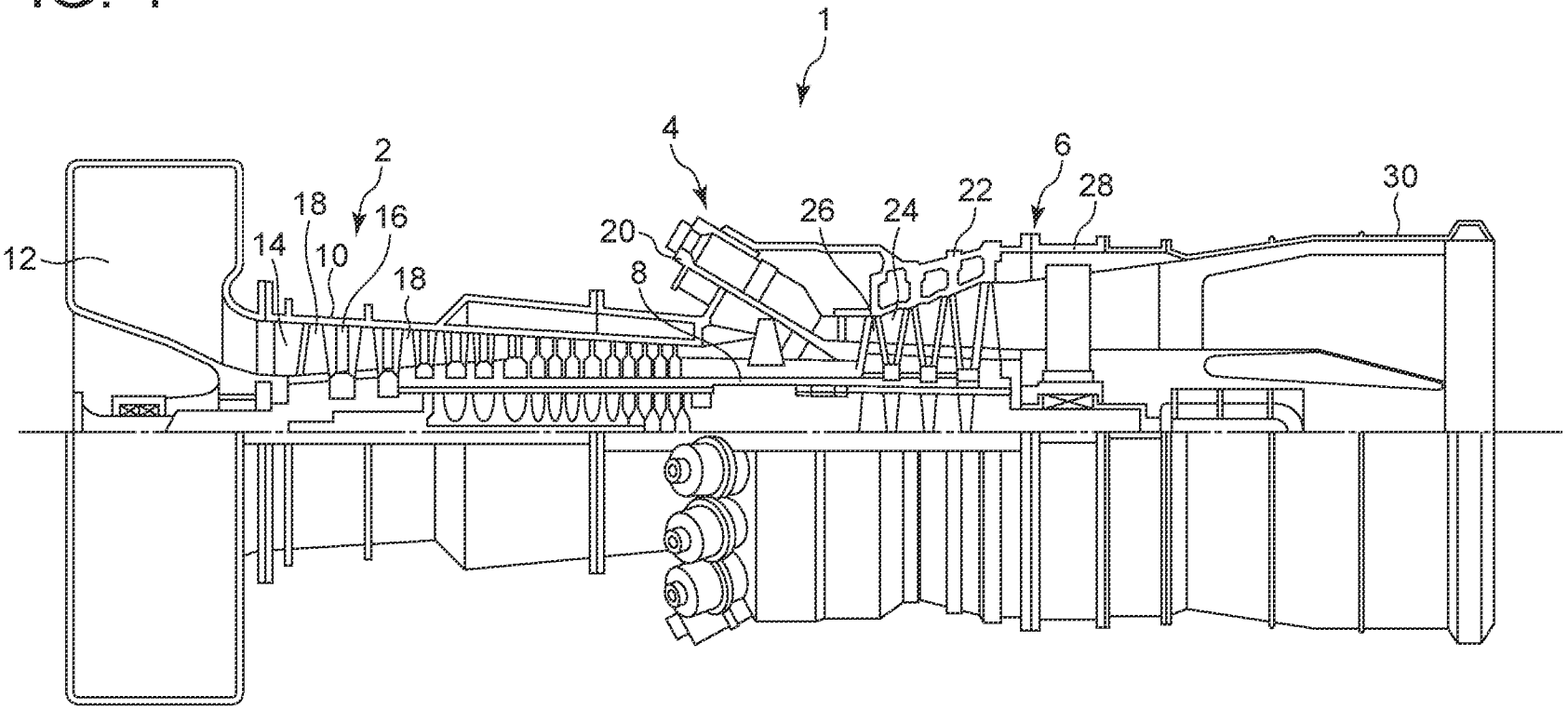
FIG. 1 is a schematic configuration diagram of a gas turbine according to some embodiments.

FIG. 1 is a schematic configuration diagram of a gas turbine according to some embodiments.

With reference to FIG. 1, a gas turbine, which is an example of application of a gas turbine combustor and a perforated plate of the gas turbine combustor according to some embodiments, will be described.

As shown in FIG. 1, a gas turbine 1 according to some embodiments includes a compressor 2 for producing compressed air that serves as an oxidant, a gas turbine combustor 4 for producing combustion gas using the compressed air and fuel, and a turbine 6 configured to be driven by the combustion gas to rotate. In the case of the gas turbine 1 for power generation, a generator (not shown) is connected to the turbine 6, so that rotational energy of the turbine 6 generates electric power. In the following description, the gas turbine combustor 4 is also simply referred to as the combustor 4.

A specific configuration example of each component of the gas turbine 1 according to some embodiments will be described.

The compressor 2 according to some embodiments includes a compressor casing 10, an air inlet 12 disposed on the inlet side of the compressor casing 10 for sucking in air, a rotor 8 disposed so as to pass through both the compressor casing 10 and a turbine casing 22, which will be described later, and a variety of blades disposed in the compressor casing 10. The variety of blades includes an inlet guide vane 14 disposed adjacent to the air inlet 12, a plurality of stator vanes 16 fixed to the compressor casing 10, and a plurality of rotor blades 18 implanted on the rotor 8 so as to be arranged alternately with the stator vanes 16. The compressor 2 may include other components, such as an extraction chamber (not shown). In the compressor 2, the air sucked in from the air inlet 12 flows through the plurality of stator vanes 16 and the plurality of rotor blades 18 to be compressed into compressed air having a high temperature and a high pressure. The compressed air having a high temperature and a high pressure is sent to the combustor 4 of a latter stage from the compressor 2.

The combustor 4 according to some embodiments is disposed in a casing 20. As shown in FIG. 1, a plurality of combustors 4 may be arranged annularly around the rotor 8 inside the casing 20. The combustor 4 is supplied with fuel and the compressed air produced by the compressor 2, and combusts the fuel to produce combustion gas that serves as a working fluid of the turbine 6. The combustion gas is sent to the turbine 6 of a latter stage from the combustor 4. The configuration example of the combustor 4 according to some embodiments will be described later in detail.

The turbine 6 according to some embodiments includes a turbine casing 22 and a variety of blades disposed in the turbine casing 22. The variety of blades includes a plurality of stator vanes 24 fixed to the turbine casing 22 and a plurality of rotor blades 26 implanted on the rotor 8 so as to be arranged alternately with the stator vanes 24. The turbine 6 may include other components, such as an outlet guide vane. In the turbine 6, the rotor 8 is driven to rotate as the combustion gas passes through the plurality of stator vanes 24 and the plurality of rotor blades 26. In this way, the generator connected to the rotor 8 is driven.

An exhaust chamber 30 is connected to the downstream side of the turbine casing 22 via an exhaust casing 28. The combustion gas having driven the turbine 6 is discharged outside through the exhaust casing 28 and the exhaust chamber 30.

(Combustor 4)

Figure 2:
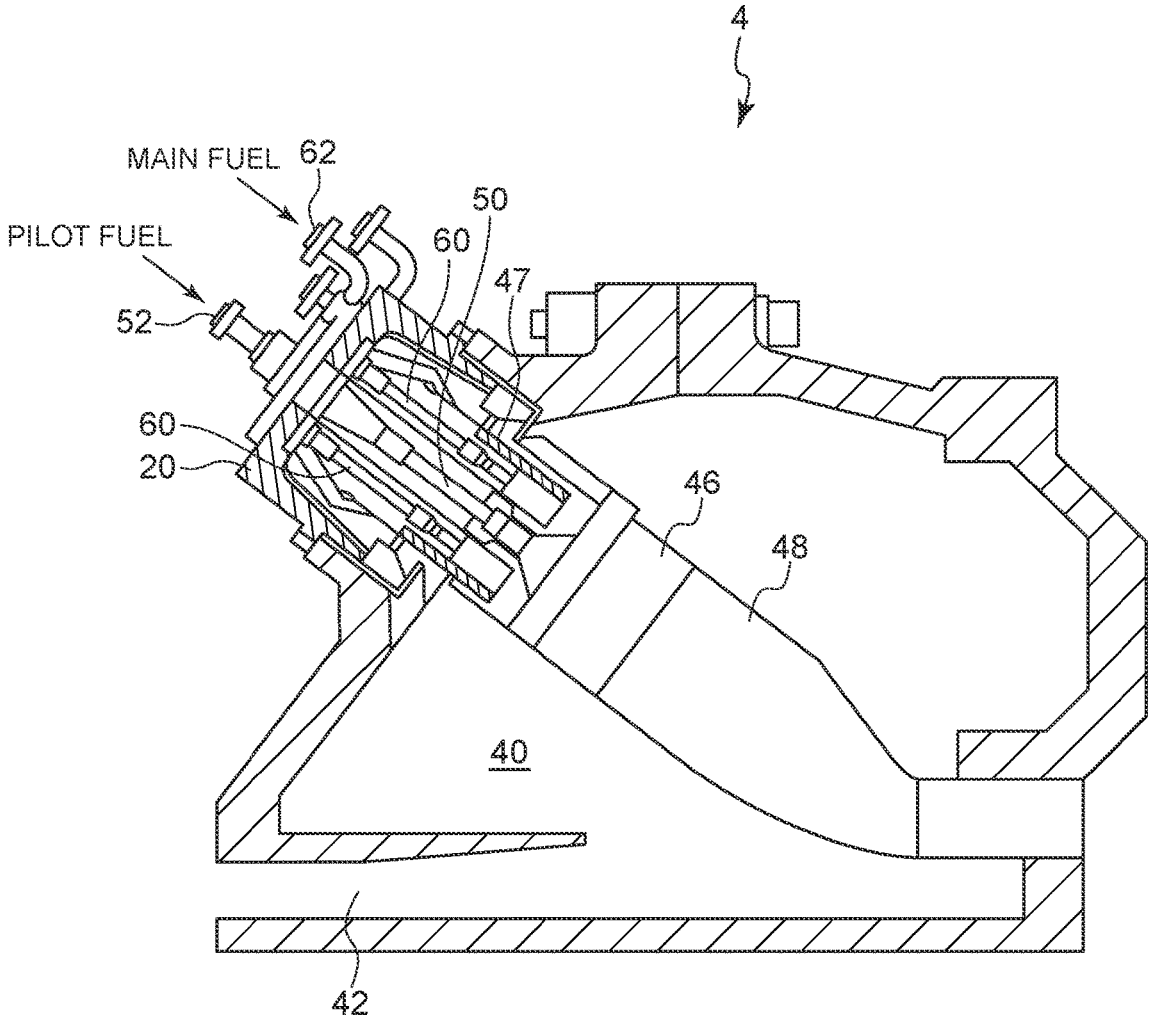
FIG. 2 is a cross-sectional view of a combustor according to some embodiments.
Figure 3:
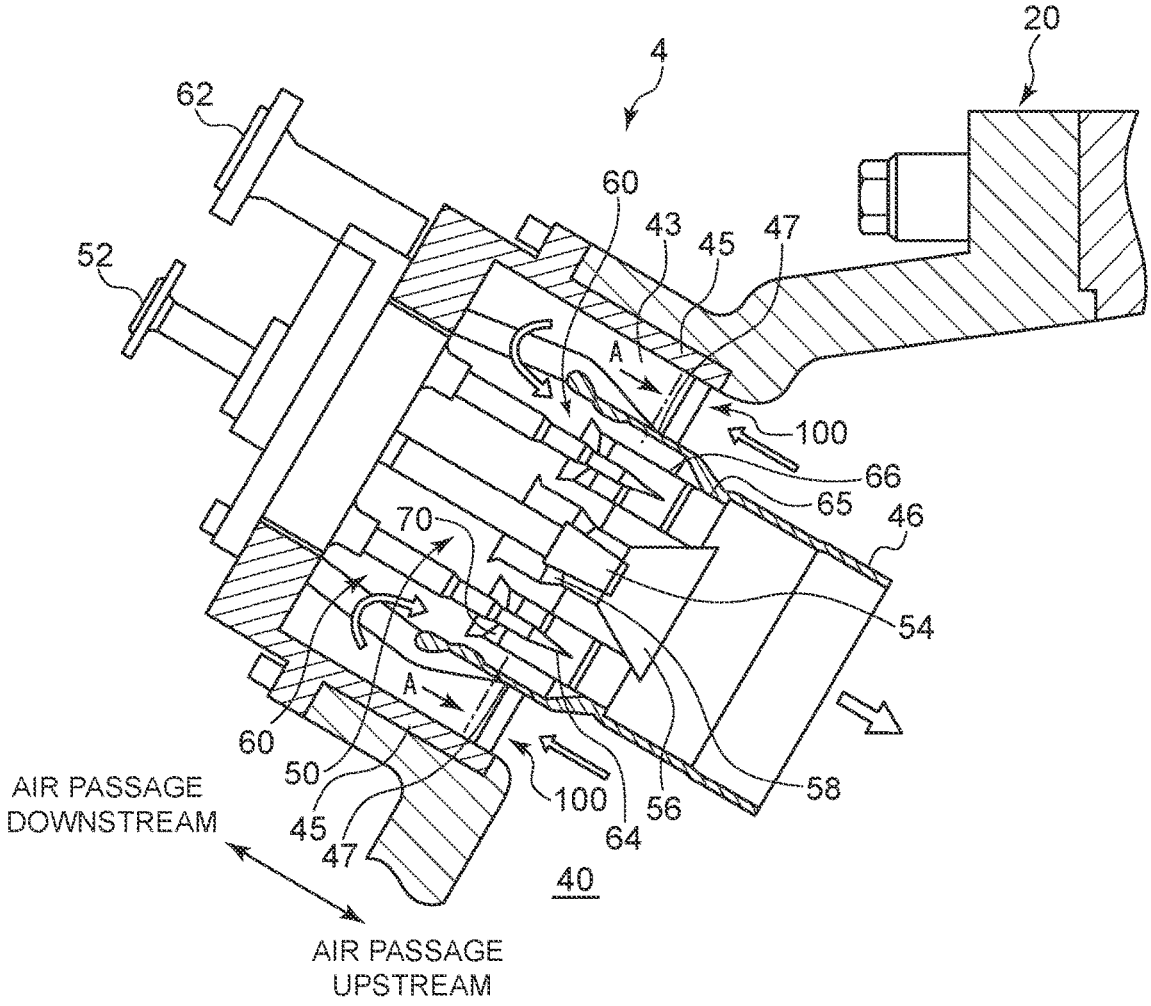
FIG. 3 is a cross-sectional view of a main portion of a combustor according to some embodiments.

FIG. 2 is a cross-sectional view of a combustor according to some embodiments. FIG. 3 is a cross-sectional view of a main portion of a combustor according to some embodiments.

With reference to FIGS. 2 and 3, a specific configuration of the combustor 4 according to some embodiments will be described.

As shown in FIGS. 2 and 3, multiple combustors 4 according to some embodiments are arranged annularly around the rotor 8 (see FIG. 1). Each combustor 4 includes a combustion liner 46 disposed in a combustor casing space 40 defined by the casing 20, and a pilot combustion burner 50 and a plurality of premixed combustion burners (main combustion burners) 60 arranged inside the combustion liner 46. The combustor 4 further includes a combustor casing 45 disposed around the outer periphery of a combustor basket 47 of the combustion liner 46 inside the casing 20. An air passage 43 through which the compressed air flows is formed between the outer periphery of the combustor basket 47 and the inner periphery of the combustor casing 45.

The combustor 4 may include other components, such as a bypass line (not shown) allowing the combustion gas to bypass.

In the combustor 4 according to some embodiments, a flow conditioning plate 100 is disposed in the air passage 43. The flow conditioning plate 100 is a perforated plate provided between the combustor basket 47 and the combustor casing 45 and fixed to an outer peripheral portion of the combustor basket 47. The flow conditioning plate 100 has a plurality of through holes (holes 110). The flow conditioning plate 100 according to some embodiments will be described later in detail.

For example, the combustion liner 46 includes a combustor basket 47 disposed around the pilot combustion burner 50 and the plurality of premixed combustion burners 60, and a transition piece 48 connected to a tip portion of the combustor basket 47.

The pilot combustion burner 50 is disposed along the central axis of the combustion liner 46. The premixed combustion burners 60 are arranged at a distance from one another so as to surround the pilot combustion burner 50.

The pilot combustion burner 50 has a pilot nozzle (nozzle) 54 connected to a fuel port 52, a pilot cone 56 disposed so as to surround the pilot nozzle 54, and a swirler 58 disposed on the outer periphery of the pilot nozzle 54.

Each premixed combustion burner 60 has a main nozzle (nozzle) 64 connected to a fuel port 62, a burner cylinder 66 disposed so as to surround the nozzle 64, an extension tube 65 connecting the burner cylinder 66 and the combustion liner 46 (for example, combustor basket 47), and a swirler 70 disposed on the outer periphery of the nozzle 64.

In the combustor 4 having the above configuration, the compressed air having a high temperature and a high pressure generated by the compressor 2 is supplied into the combustor casing space 40 through a casing inlet 42, and then is introduced from the combustor casing space 40 to the burner cylinder 66 through the air passage 43. The compressed air flowing through the air passage 43 is conditioned by passing through the plurality of holes 110 formed in the flow conditioning plate 100. Then, the compressed air and the fuel supplied from the fuel port 62 are premixed in the burner cylinder 66. At this time, the premixed air is mainly formed into a swirl flow by the swirler 70, and flows into the combustion liner 46. Further, the compressed air and the fuel injected from the pilot combustion burner 50 via the fuel port 52 are mixed in the combustion liner 46 and ignited by a pilot light (not shown) to be combusted, whereby the combustion gas is produced. At this time, a part of the combustion gas diffuses to the surroundings with flames, which ignite the premixed air flowing into the combustion liner 46 from each premixed combustion burner 60 to cause combustion. That is, the pilot flames produced by the pilot fuel injected from the pilot combustion burner 50 hold flames for stable combustion of the premixed air (premixed fuel) from the premixed combustion burners 60.

(Flow Conditioning Plate (Perforated Plate) 100)

Figure 4:
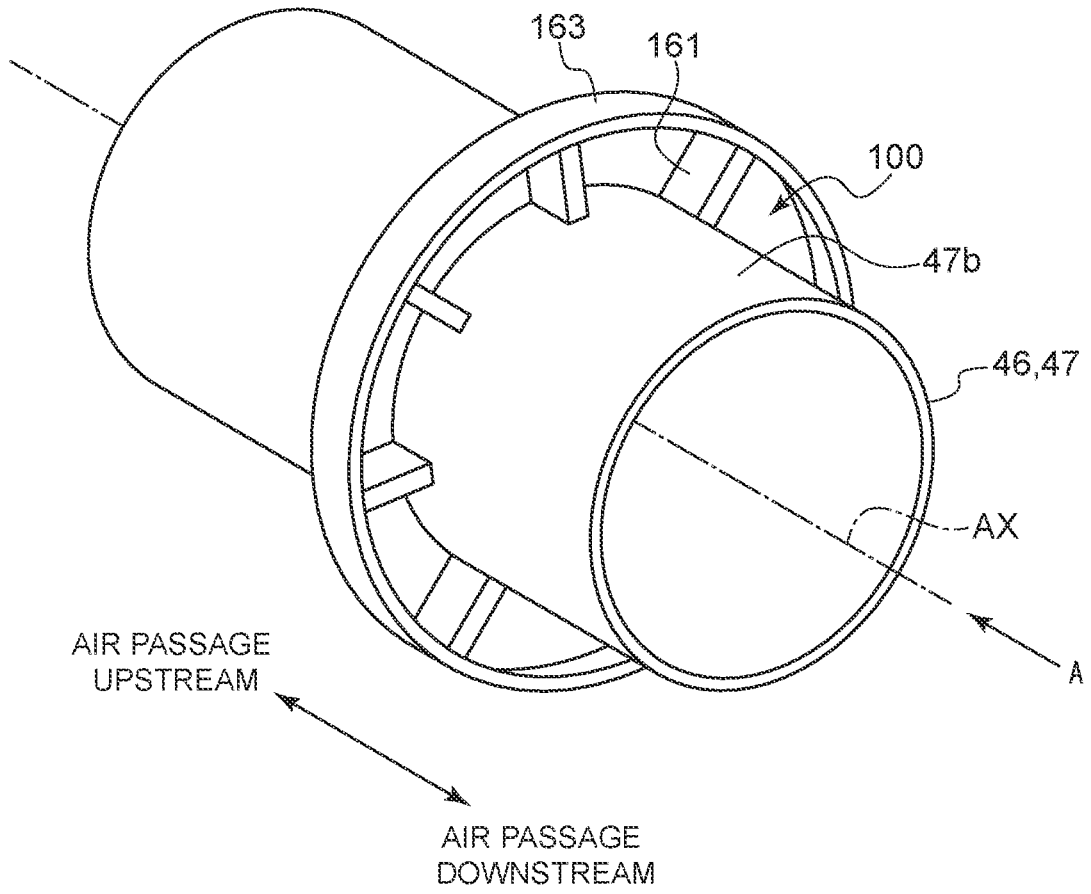
FIG. 4 is a perspective view of a combustor basket and a flow conditioning plate according to some embodiments, viewed from the downstream side of an air passage.

FIG. 4 is a perspective view of a combustor basket and a flow conditioning plate according to some embodiments, viewed from the downstream side of the air passage. In FIG. 4, holes 110, which will be described later, are not depicted.

Figure 5:
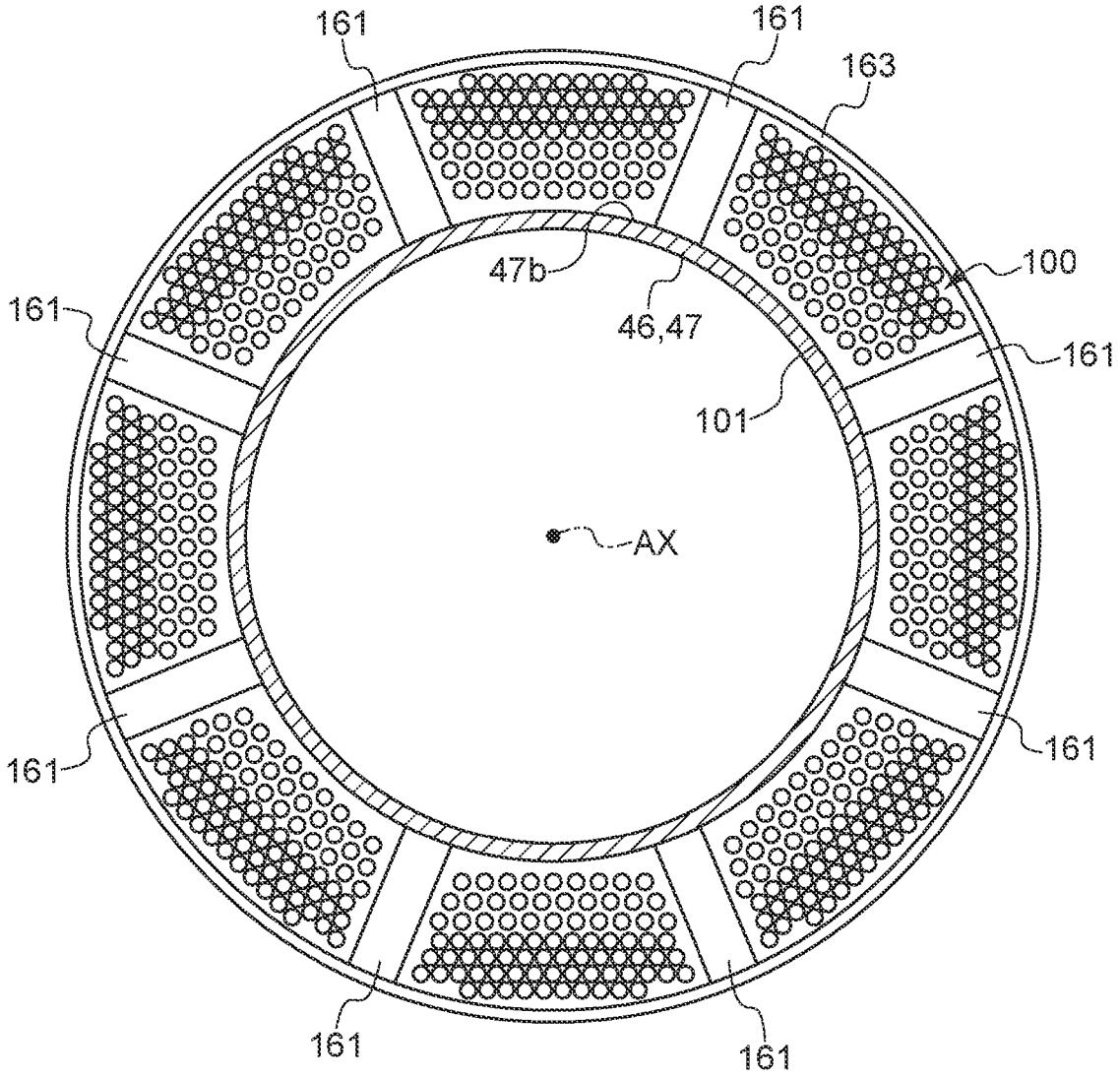
FIG. 5 is a cross-sectional view of the combustor basket and the flow conditioning plate according to some embodiments, taken along line A-A in FIG. 3.

FIG. 5 is a cross-sectional view of the combustor basket and the flow conditioning plate according to some embodiments, taken along line A-A in FIG. 3.

Figure 6:
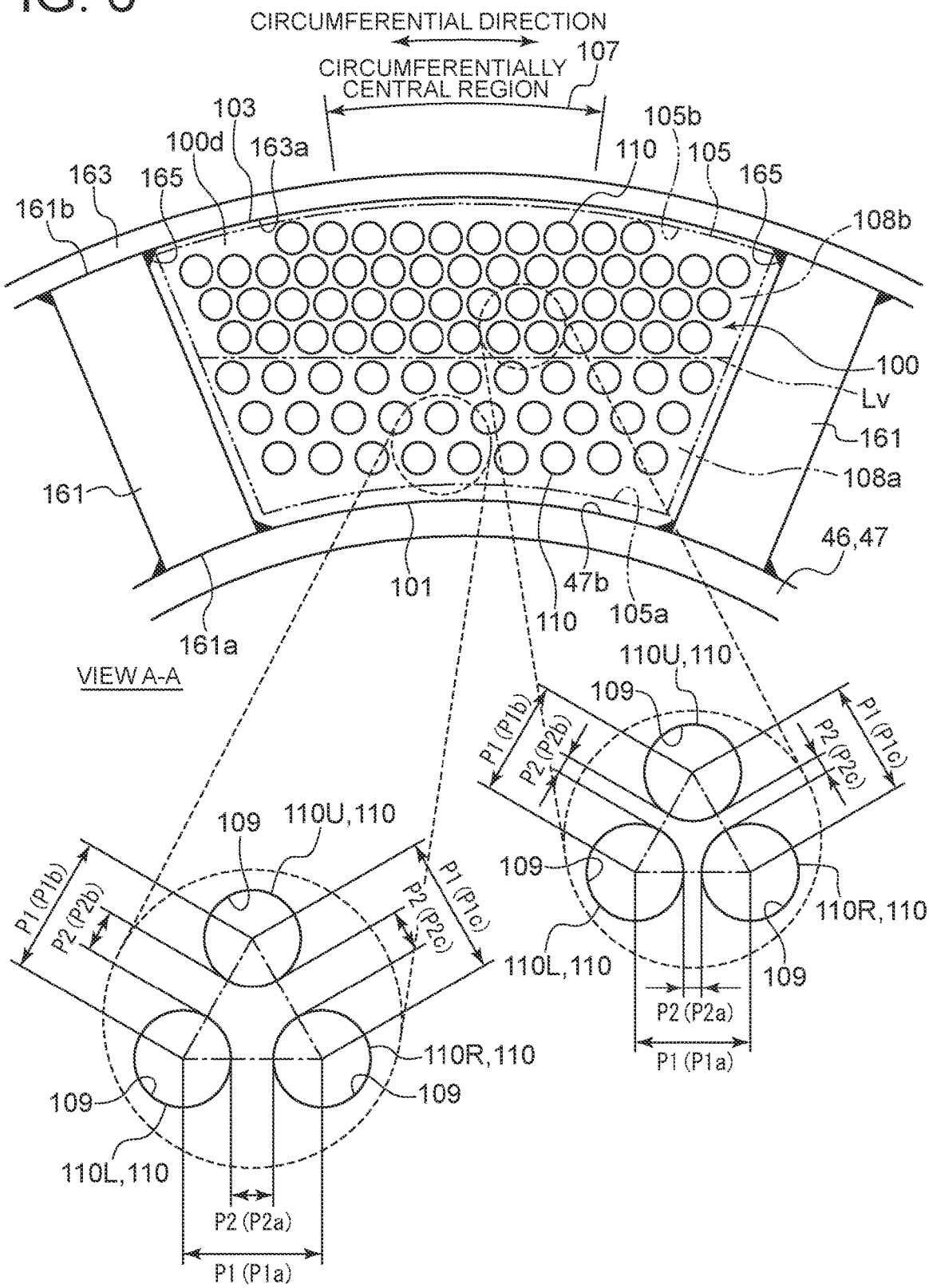
FIG. 6 is a diagram for describing holes of the flow conditioning plate according to some embodiments.

FIG. 6 is a diagram for describing holes of the flow conditioning plate according to some embodiments.

In the following description, the radial direction with respect to the central axis AX of the combustor basket 47 is referred to as the radial direction of the combustor 4 or simply the radial direction. Further, in the following description, the circumferential direction with respect to the central axis AX of the combustor basket 47 is referred to as the circumferential direction of the combustor 4 or simply the circumferential direction.

The flow conditioning plate 100 according to some embodiments is a perforated plate provided at an inlet portion of the air passage 43 and having a large number of holes 110 for connecting the upstream and downstream sides of the air passage 43. The flow conditioning plate 100 according to some embodiments is a ring-shaped plate member and is configured to surround the combustor basket 47. The flow conditioning plate 100 according to some embodiments is provided with ribs 161 at equal intervals in the circumferential direction for fixing the flow conditioning plate 100 at the downstream side of the flow conditioning plate 100 in the air passage 43. The ribs 161 are radially arranged in the radial direction so that both ends are in contact with the combustor basket 47 and a ring member 163 disposed to face the inner peripheral surface of the combustor casing 45. In the following description, the flow conditioning plate 100 is also referred to as a perforated plate 100.

The perforated plate 100 according to some embodiments is joined to an outer peripheral portion of the combustor basket 47 by welding. That is, a radially inner end portion 101 of the perforated plate 100 according to some embodiments is joined to an outer peripheral surface 47*b* of the combustor basket 47 by welding.

In the combustor 4 according to some embodiments, a radially inner end portion 161*a* of the rib 161 is joined to the outer peripheral surface 47*b* of the combustor basket 47 by fillet welding.

In the combustor 4 according to some embodiments, a radially outer end portion 161*b* of the rib 161 is joined to an inner peripheral surface 163*a* of the ring member 163 by fillet welding.

The perforated plate 100 according to some embodiments is joined by welding to the rib 161 and the ring member 163 at a fillet weld portion 165 between the end portion 161*b* of the rib 161 and the inner peripheral surface 163*a* of the ring member 163 in the vicinity of a radially outer end portion 103 on a surface 100*d* of the perforated plate 100 facing downstream in the air passage 43.

When the perforated plate 100 is fixed to the outer peripheral portion of the combustor basket 47 as in some embodiments, the combustion oscillation during operation of the gas turbine 1 causes a region of the perforated plate 100 close to the combustor casing 45 to oscillate against the fixed portion of the perforated plate 100 close to the combustor basket 47. Accordingly, the stress acting on the perforated plate 100 due to the oscillation increases from the radially outer side to the radially inner side. Therefore, when such oscillation of the perforated plate 100 occurs, the stress acting on the fixed portion of the perforated plate 100 adjacent to the combustor basket 47 increases, which may cause deformation of the perforated plate 100 or damage such that the holes 110 of the perforated plate 100 are connected to each other.

In order to reduce the stress, it is conceivable to reduce the aperture ratio of the holes 110 (the area of holes 110 per unit area) in the perforated plate 100 and increase the area of the region without holes 110. However, generally, it is desirable to increase the aperture ratio of the flow conditioning plate from the viewpoint of ensuring the flow rate of air passing through the plurality of holes.

Therefore, in some embodiments, the above-described problem is solved by configuring the perforated plate 100 as follows. Specifically, in some embodiments, in a hole arrangement area 105 with a plurality of through holes (holes 110), a region close to the combustor basket 47 (inner region 108*a*) has a larger average value of a ligament ratio (P2/P1) than a region close to the combustor casing 45 (outer region 108*b*), where the ligament ratio is obtained by dividing a distance P2 between outer peripheral edges 109 of two adjacent holes 110 of the plurality of through holes (holes 110) by a distance P1 between the centers of the two holes 110. That is, in some embodiments, the perforated plate 100 is configured such that, in the hole arrangement area 105 with a plurality of through holes (holes 110), a region close to the combustor basket 47 (inner region 108*a*) has a larger average value of the ligament ratio (P2/P1) than a region close to the combustor casing 45 (outer region 108*b*).

This configuration will now be described.

In the perforated plate 100 according to some embodiments, as described above, the ribs 161 are radially arranged. Therefore, in View A-A of FIG. 3, the region where the holes 110 can be provided is between two circumferentially adjacent ribs 161 and between the outer peripheral surface 47*b* of the combustor basket 47 and the inner peripheral surface 163*a* of the ring member 163. This partially annular region is referred to as a hole arrangement area 105 (see FIG. 6).

In the hole arrangement area 105, the region close to the combustor basket 47 is also referred to as an inner region 108*a*, and the region close to the combustor casing 45 is also referred to as an outer region 108*b*.

For example, in FIG. 6, the region below the imaginary line Lv of the two-dotted dashed line extending in the right-left direction may be the inner region 108*a*, and the region above the imaginary line Lv may be the outer region 108*b*. The inner region 108*a* and the outer region 108*b* do not have to be in contact with each other across the imaginary line Lv, but the inner region 108*a* and the outer region 108*b* may be separated from each other in the radial direction. Further, in FIG. 6, the imaginary line Lv is illustrated as a straight line extending in the right-left direction, but the imaginary line Lv may be a curved line. For example, the imaginary line Lv may have an arc shape centered on the central axis AX of the combustor basket 47.

The ligament ratio is a value (P2/P1) obtained by dividing the distance P2 between the outer peripheral edges 10) of two adjacent holes 110 of the plurality of holes 110 by the distance P1 between the centers of the two holes 110. Therefore, the larger the ligament ratio, the larger the distance P2 between the outer peripheral edges 109 of the two adjacent holes 110 relative to the distance P1 between the centers of the two holes 110, and thus the larger the proportion of the portion without the holes 110, i.e., the portion corresponding to a frame in the perforated plate 100. Accordingly, the larger the ligament ratio, the smaller the aperture ratio of the holes 110 but the larger the area of the region without the holes 110, and the greater the strength of the perforated plate 100.

Therefore, as described above, when the perforated plate 100 is configured such that the inner region 108*a* has a larger average value of the ligament ratio (P2/P1) than the outer region 108*b*, the proportion of the area of the region without the holes 110 per unit area in the perforated plate 100 is larger in the inner region 108*a* than in the outer region 108*b*, so that the strength of the perforated plate 100 is improved. As a result, the stress on the perforated plate 100, which tends to increase from the radially outer side to the radially inner side as described above, can be effectively alleviated while suppressing the effect on the aperture ratio of the holes 110.

In some embodiments, the perforated plate 100 may have a radial distribution in which the ligament ratio increases from the radially outer side to the radially inner side at least in a partial region of the hole arrangement area 105.

With this configuration, at least in the partial region of the hole arrangement area 105, the proportion of the area of the region without the holes 110 per unit area in the perforated plate 100 increases from the radially outer side to the radially inner side, so that the strength of the perforated plate 100 is improved. As a result, the stress on the perforated plate 100, which tends to increase from the radially outer side to the radially inner side as described above, can be effectively alleviated while suppressing the effect on the aperture ratio of the holes 110.

In some embodiments, the perforated plate 100 has a plurality of radially extending support members (ribs 161) arranged in the circumferential direction. The hole arrangement area 105 is a partially annular region partitioned in the circumferential direction by adjacent support members (ribs 161). The perforated plate 100 may have a radial distribution in which the ligament ratio increases from the radially outer side to the radially inner side in a circumferentially central portion of the partially annular region (hole arrangement area 105) as the partial region of the hole arrangement area 105.

With this configuration, at least in the circumferentially central portion of the hole arrangement area 105, the proportion of the area of the region without the holes 110 per unit area in the perforated plate 100 increases from the radially outer side to the radially inner side, so that the strength of the perforated plate 100 is improved. As a result, the stress on the perforated plate 100, which tends to increase from the radially outer side to the radially inner side as described above, can be effectively alleviated while suppressing the effect on the aperture ratio of the holes 110.

In some embodiments, the perforated plate 100 may be configured to have a radial distribution in which the ligament ratio (P2/P1) increases from the radially outer side to the radially inner side at least in a circumferentially central region 107 of the partially annular hole arrangement area 105 with the plurality of through holes (holes 110).

With this configuration, at least in the circumferentially central region 107 of the hole arrangement area 105, the proportion of the area of the region without the holes 110 per unit area in the perforated plate 100 increases from the radially outer side to the radially inner side, so that the strength of the perforated plate 100 is improved. As a result, the stress on the perforated plate 100, which tends to increase from the radially outer side to the radially inner side as described above, can be effectively alleviated while suppressing the effect on the aperture ratio of the holes 110.

In the embodiment shown in FIG. 6, in the hole arrangement area 105, holes 110 are aligned in the right-left direction to form a row, and multiple rows of holes 110 are arranged in the upper-lower direction.

More specifically, in the embodiment shown in FIG. 6, the right-left direction coincides with the extension direction (tangential direction) of a tangent to an imaginary circle (not shown) centered on the central axis AX of the combustor basket 47 at the circumferentially central position of the hole arrangement area 105. That is, in the embodiment shown in FIG. 6, the holes 110 are aligned in the tangential direction.

Further, in the embodiment shown in FIG. 6, the ligament ratio in the lower three rows of the multiple rows of holes 110 is larger than the ligament ratio in the upper four rows of the multiple rows of holes 110.

For example, in the embodiment shown in FIG. 6, of the three holes 110 within the circle surrounded by the dashed line, the hole 110 on the left side of the two holes 110 arranged in the tangential direction is referred to as a left hole 110L, and the hole 110 on the right side of the two holes 110 arranged in the tangential direction is referred to as a right hole 110R. Further, of the three holes 110 within the circle surrounded by the dashed line, the hole 110 above the two holes 110 arranged in the tangential direction is referred to as an upper hole 110U.

Regarding the three holes 110 within the dashed circle, the ligament ratio (P2*a*/P1*a*) for the left hole 110L and the right hole 110R, the ligament ratio (P2*b*/P1*b*) for the left hole 110L and the upper hole 110U, and the ligament ratio (P2*c*/P1*c*) for the right hole 110R and the upper hole 110U may be the same.

Alternatively, of the three ligament ratios, one ligament ratio may be different from the other two ligament ratios, or all three ligament ratios may be different.

In some embodiments, in the perforated plate 100, a circumferential ligament ratio which is an average value of the ligament ratio in the circumferential direction may increase from the radially outer side to the radially inner side at least in a partial region of the hole arrangement area 105.

With this configuration, the area of the region without the holes 110 increases from the radially outer side to the radially inner side in the partial region, so that the strength of the perforated plate 100 is improved.

In some embodiments, in the perforated plate 100, a circumferential ligament ratio which is an average value of the ligament ratio in the circumferential direction may increase from the radially outer side to the radially inner side.

With this configuration, even if the ligament ratio decreases from the radially outer side to the radially inner side in a part of the perforated plate 100 in the circumferential direction, the ligament ratio increases from the radially outer side to the radially inner side as a whole in the circumferential direction. Accordingly, the area of the region without the holes 110 increases from the radially outer side to the radially inner side over the entire circumference, so that the strength of the perforated plate 100 is improved.

Figure 7A:
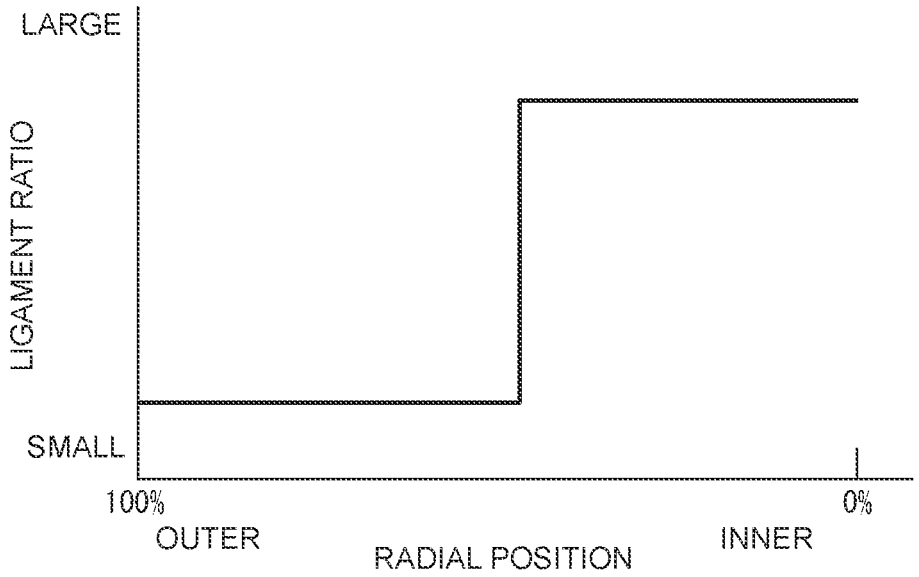
FIG. 7A is an example of a graph showing a radial distribution of ligament ratio.

FIG. 7A is an example of a graph showing a radial distribution of ligament ratio, for example, a radial direction of ligament ratio in the embodiment shown in FIG. 6. In the graph shown in FIG. 7A, the horizontal axis represents the radial position, and the vertical axis represents the ligament ratio.

Figure 7B:
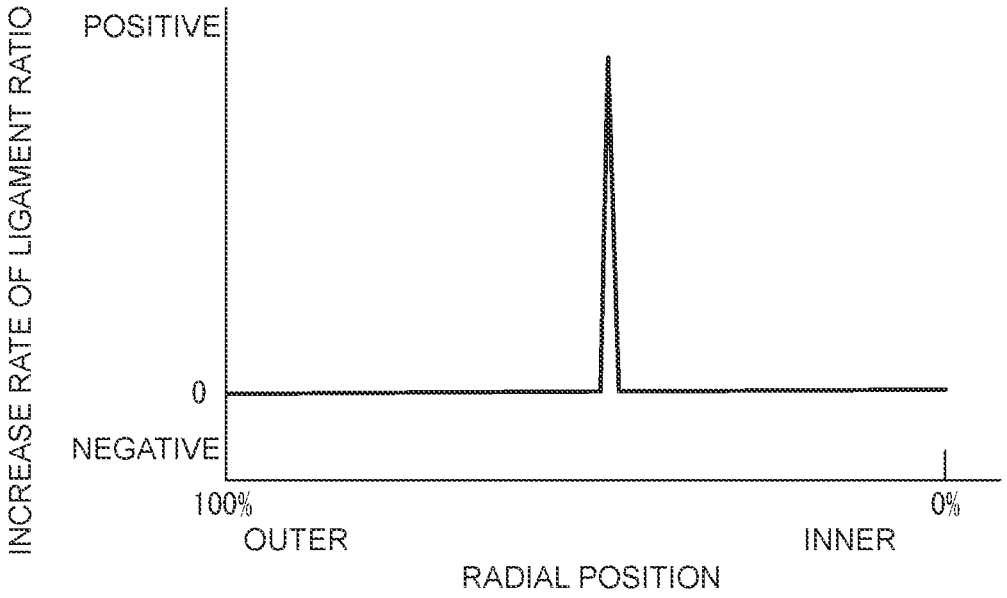
FIG. 7B is an example of a graph showing a radial distribution of increase rate of ligament ratio.

FIG. 7B is an example of a graph showing a radial distribution of increase rate of ligament ratio in the graph shown in FIG. 7A, for example, a radial direction of increase rate of ligament ratio in the embodiment shown in FIG. 6. In the graph shown in FIG. 7B, the horizontal axis represents the radial position, and the vertical axis represents the increase rate of ligament ratio.

Here, the increase rate of ligament ratio is a ratio of change in ligament ratio to change in radial position. More specifically, the increase rate of ligament ratio is a ratio of increase in ligament ratio to change in radial position toward the radially inner side.

In the graphs shown in FIGS. 7A and 7B and later-described graphs, the radial position of a radially inner end portion 105*a* of the hole arrangement area 105 (see FIG. 6) is 0% and the radial position of a radially outer end portion 105*b* of the hole arrangement area 105 is 100%.

As shown in FIG. 7A, in the embodiment shown in FIG. 6, the ligament ratio is different between the radially inner side and the radially outer side of a radial boundary position, but the ligament ratio is constant within the region on the radially inner side of the boundary position regardless of the radial position. Similarly, the ligament ratio is constant within the region on the radially outer side of the boundary position regardless of the radial position.

As shown in FIG. 7B, for example in the embodiment shown in FIG. 6, the increase rate of ligament ratio is positive and relatively large at the boundary position, while it is zero at the other radial positions.

Figure 8A:
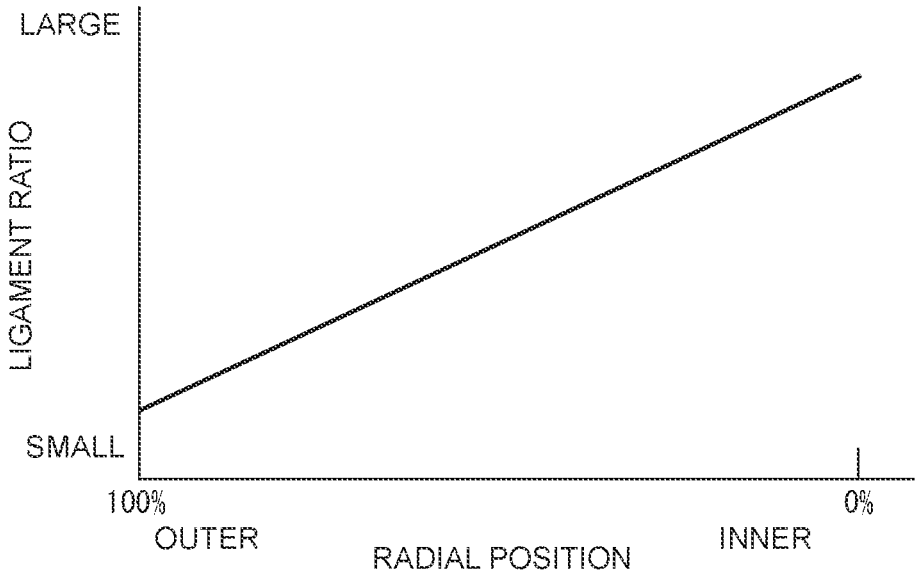
FIG. 8A is an example of a graph showing a radial distribution of ligament ratio.

FIG. 8A is another example of a graph showing a radial distribution of ligament ratio. In the graph shown in FIG. 8A, the horizontal axis represents the radial position, and the vertical axis represents the ligament ratio.

Figure 8B:
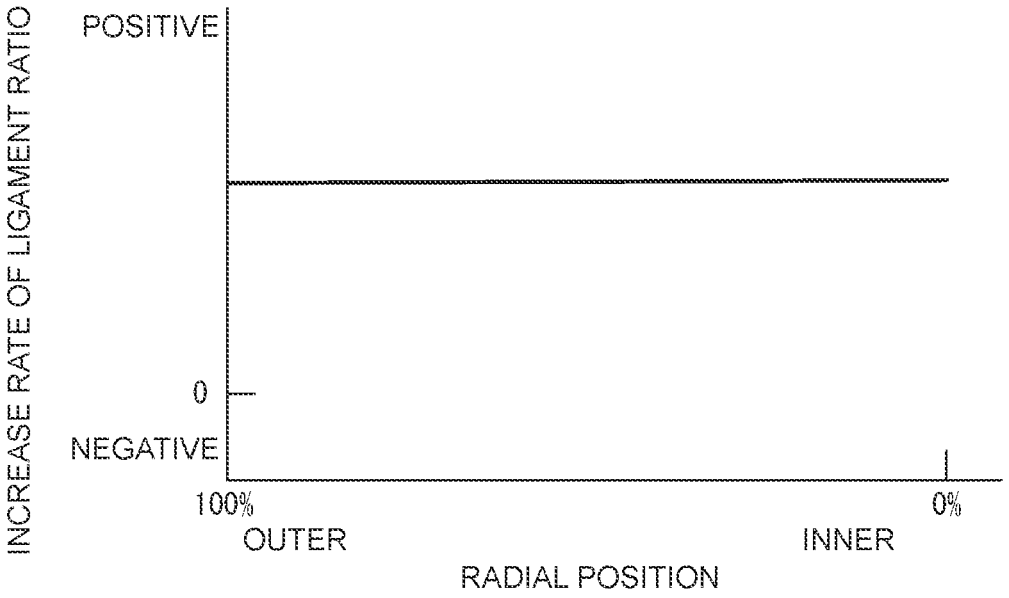
FIG. 8B is an example of a graph showing a radial distribution of increase rate of ligament ratio.

FIG. 8B is an example of a graph showing a radial distribution of increase rate of ligament ratio in the graph shown in FIG. 8A. In the graph shown in FIG. 8B, the horizontal axis represents the radial position, and the vertical axis represents the increase rate of ligament ratio.

For example, in the graph shown in FIG. 8A, the ligament ratio increases linearly toward the radially inner side. That is, in the graph shown in FIG. 8A, the increase rate of ligament ratio is a constant positive value regardless of the radial position, as shown in FIG. 8B.

Figure 9A:
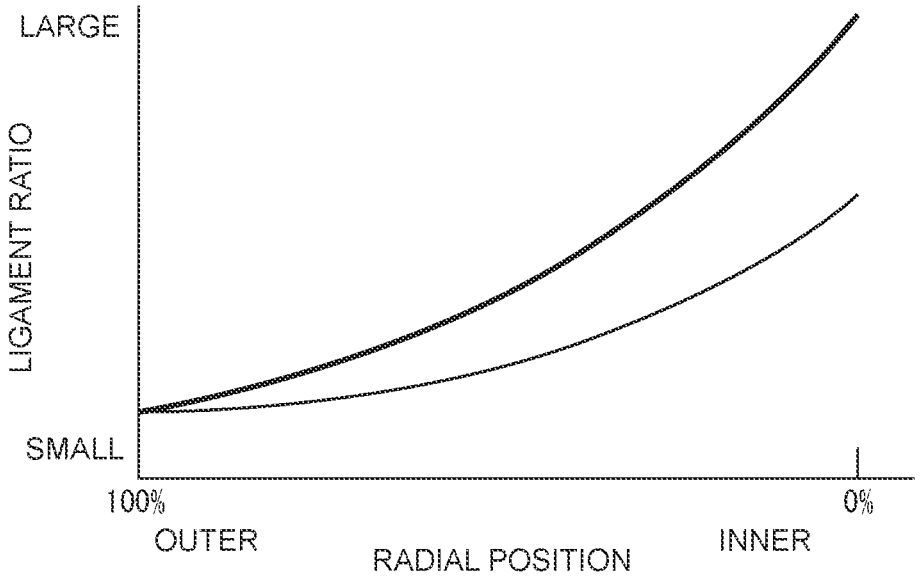
FIG. 9A is an example of a graph showing a radial distribution of ligament ratio.

FIG. 9A is another example of a graph showing a radial distribution of ligament ratio. In the graph shown in FIG. 9A, the horizontal axis represents the radial position, and the vertical axis represents the ligament ratio.

Figure 9B:
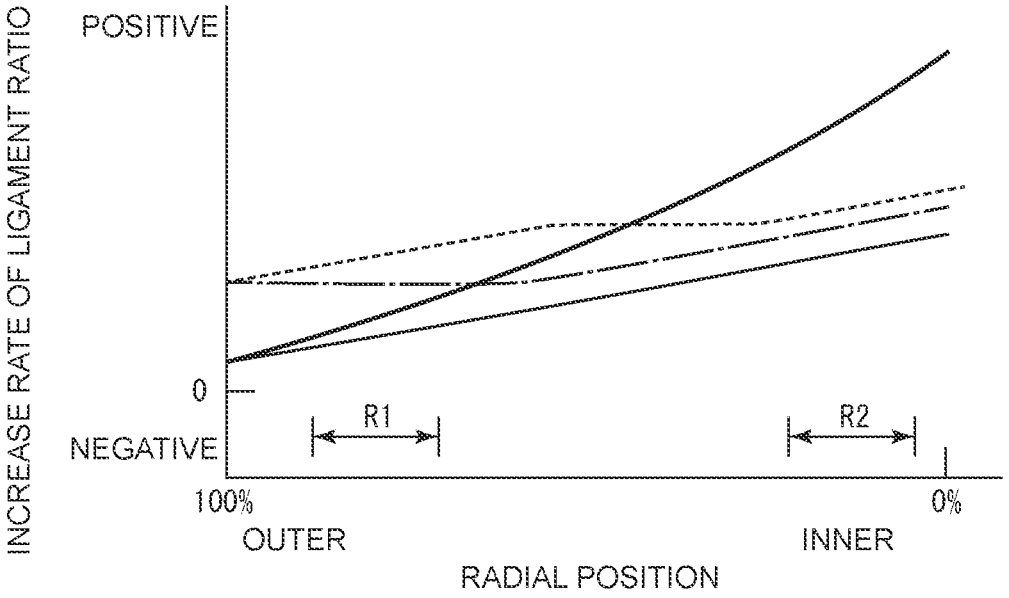
FIG. 9B is an example of a graph showing a radial distribution of increase rate of ligament ratio.

FIG. 9B is an example of a graph showing a radial distribution of increase rate of ligament ratio in the graph shown in FIG. 9A. In the graph shown in FIG. 9B, the horizontal axis represents the radial position, and the vertical axis represents the increase rate of ligament ratio.

For example, in the graph shown in FIG. 9A, in each of the thin and bold graph lines, the ligament ratio increases toward the radially inner side, while the rate of increase also increases toward the radially inner side.

In FIG. 9A, the thin graph line is a graph line when the increase rate of ligament ratio increases linearly toward the radially inner side, as indicated by the thin solid line in FIG. 9B, for example.

In FIG. 9A, the bold graph line is a graph line when the increase rate of ligament ratio increases toward the radially inner side while the rate of increase also increases toward the radially inner side, as indicated by the bold solid line in FIG. 9B, for example.

The increase rate of ligament ratio may not monotonically increase toward the radially inner side, but may be constant in a certain radial region regardless of the radial position, as indicated by the dashed line or the dotted and dashed line in FIG. 9B, for example.

Figure 10A:
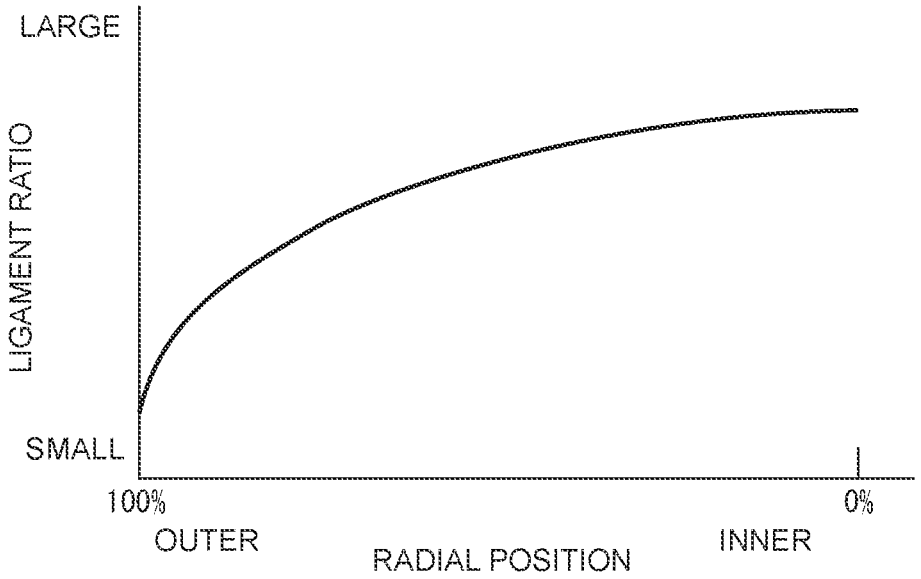
FIG. 10A is an example of a graph showing a radial distribution of ligament ratio.

FIG. 10A is another example of a graph showing a radial distribution of ligament ratio. In the graph shown in FIG. 10A, the horizontal axis represents the radial position, and the vertical axis represents the ligament ratio.

Figure 10B:
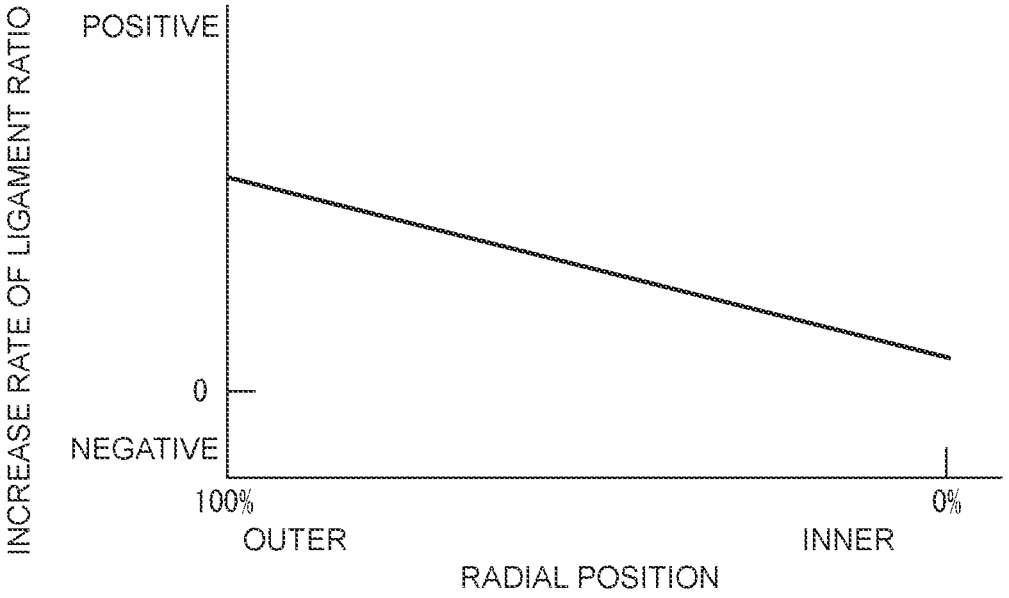
FIG. 10B is an example of a graph showing a radial distribution of increase rate of ligament ratio.

FIG. 10B is an example of a graph showing a radial distribution of increase rate of ligament ratio in the graph shown in FIG. 10A. In the graph shown in FIG. 10B, the horizontal axis represents the radial position, and the vertical axis represents the increase rate of ligament ratio.

For example, as shown in FIG. 10A, the ligament ratio may increase toward the radially inner side, while the rate of increase decreases toward the radially inner side.

For example, as shown in FIG. 10B, the increase rate of ligament ratio may be positive but decrease toward the radially inner side.

For example, as indicated by each graph line in FIG. 9B, a second ratio may be larger than a first ratio, where the first ratio is the increase rate of ligament ratio, i.e., the ratio ($\Delta r/\Delta d$) of change $\Delta r$ in ligament ratio to change $\Delta d$ in radial position in a first radial range R1, and the second ratio is the ratio ($\Delta r/\Delta d$) in a second radial range R2 that is radially inward of the first radial range R1.

With this configuration, the ratio (increase rate of ligament ratio) is larger in a relatively radially inner region (e.g., second range R2) than in a relatively radially outer region (e.g., first range R1). Thus, the strength of the perforated plate 100 can be improved in the relatively radially inner region while ensuring the aperture ratio and thus the flow rate of air passing through the plurality of holes 110 in the relatively radially outer region.

For example, as indicated by the solid graph line in FIG. 9B, the increase rate of ligament ratio, i.e., the ratio ($\Delta r/\Delta d$) of change $\Delta r$ in ligament ratio to change $\Delta d$ in radial position may gradually increase from the radially outer side to the radially inner side.

With this configuration, the above-described ratio increases toward the radially inner side. Thus, the strength of the perforated plate 100 can be improved in the relatively radially inner region while ensuring the aperture ratio and thus the flow rate of air passing through the plurality of holes 110 in the relatively radially outer region.

The increase rate of ligament ratio may gradually increase from the radially outer side to the radially inner side at least in the circumferentially central region 107.

When the radial position of the radially inner end portion 105*a* of the hole arrangement area 105 (see FIG. 6) is 0% and the radial position of the radially outer end portion 105*b* of the hole arrangement area 105 is 100%, the ligament ratio according to some embodiments may have the following value.

For example, the ligament ratio may be 0.10 or more within the range of 0% or more and 50% or less of radial position of the hole arrangement area 105.

For example, the ligament ratio may be 0.11 or more within the range of 0% or more and 25% or less of radial position of the hole arrangement area 105.

For example, the ligament ratio may be 0.15 or more within the range of 0% or more and 12.5% or less of radial position of the hole arrangement area 105.

(Aperture Ratio)

In the following description, the aperture ratio of the holes 110 in the perforated plate 100, more specifically, the aperture ratio of the holes 110 in the hole arrangement area 105 is a value expressed as a percentage of the total area of the holes 110 per unit area in the hole arrangement area 105.

In some embodiments, the aperture ratio of the plurality of holes 110 in the hole arrangement area 105 may be 45% or more and 70% or less.

If the aperture ratio is less than 45%, it may be difficult to ensure the flow rate of air passing through the plurality of holes 110, that is, the amount of air required in the combustor 4. Further, if the aperture ratio is more than 70%, the strength of the perforated plate 100 may be impaired.

Therefore, by setting the aperture ratio to 45% or more and 70% or less, the strength of the perforated plate 100 can be ensured while ensuring the flow rate of air passing through the plurality of holes 110.

(Arrangement of Holes 110)

For example, as shown in FIG. 6, in some embodiments, instead of each two circumferentially adjacent holes 110 being at the same radial position, multiple rows of holes 110, each aligned in the right-left direction, may be arranged in multiple stages in the upper-lower direction. In other words, for example, as shown in FIG. 6, in some embodiments, the plurality of holes 110 may have a pair of holes 110 that are arranged adjacent to each other in the circumferential direction at different radial positions.

With this configuration, the arrangement density of the holes 110 can be relatively increased, so that the flow rate of air passing through the plurality of holes 110 can be ensured.

(Shape of Holes 110)

For example, as shown in FIG. 6, in some embodiments, at least in the circumferentially central region 107, the plurality of holes 110 may be round holes.

The holes 110 of round is easier to machine than the holes 110 of rectangular or the like.

(Size of Holes 110)

Figure 11:
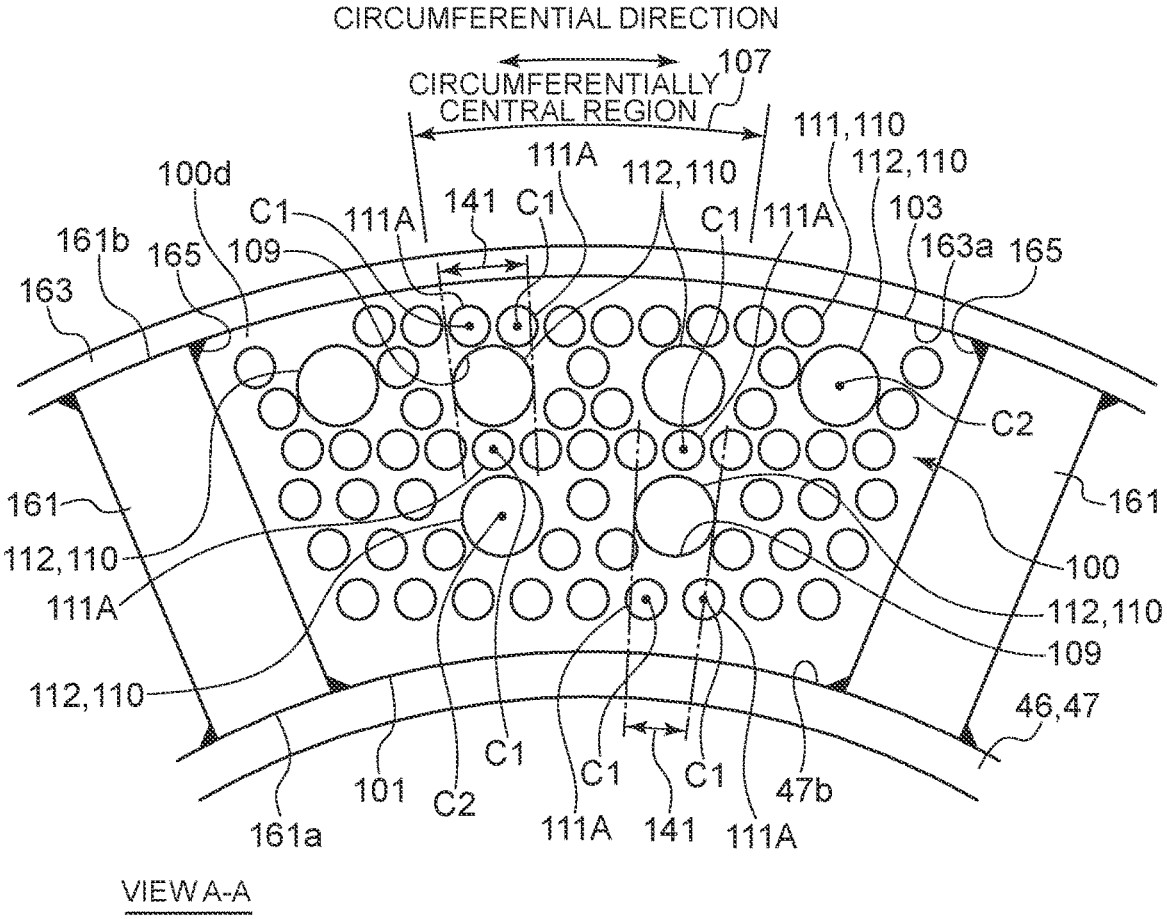
FIG. 11 is a diagram showing an example of another embodiment of the size of holes.

FIG. 11 is a diagram showing an example of another embodiment of the size of holes 110.

In the perforated plate 100 according to some embodiments, for example, as shown in FIG. 11, the plurality of holes 110 may include a plurality of first holes 111, and at least one second hole 112 having a larger opening area than that of each first hole 111.

For example, in the embodiment shown in FIG. 11, in the hole arrangement area 105 (see FIG. 6), two rows of second holes 112, each aligned in the right-left direction, are arranged in the upper-lower direction. The number of second holes 112 in the radially inner row may be, for example, two, and the number of second holes 112 in the radially outer row may be, for example, four.

Even if one of the two adjacent holes 110 is the first hole 111 and the other is the second hole 112, there may be a radial distribution in which the ligament ratio of these two holes 111 and 112 increases from the radially outer side to the radially inner side.

For example, as in the embodiment shown in FIG. 11, the centers C1 of at least some of the plurality of first holes 111 may be located radially outward and radially inward of an opening edge (outer peripheral edge 109) of the second hole 112 and within a circumferential range 141 of the outer peripheral edge 109 of the second hole 112.

Generally, airflow having passed through a hole with a relatively small opening area is more likely to maintain velocity in a radially central region of the airflow than airflow having passed through a hole with a relatively large opening area. Therefore, for example, according to the embodiment shown in FIG. 11, since the first holes 111 having a smaller opening area than that of the second hole 112 are arranged radially outward and radially inward of the second hole 112, the difference in velocity (difference in pressure) between the air having passed through the first holes 111 and the air having passed through the second hole 112 increases, and a secondary flow is generated. This promotes mixing of the air having passed through the first holes 111 and the air having passed through the second hole 112, suppressing an unbalanced air flow in the combustor 4.

For example, when the radial position of the radially inner end portion 105*a* of the hole arrangement area 105 (see FIG. 6) is 0% and the radial position of the radially outer end portion 105*b* of the hole arrangement area 105 is 100%, the radial position of the center C2 of the at least one second hole 112 may be within the range of 25% or more and 75% or less.

If the radial position of the center C2 of the at least one second hole 112 is out of this range, there is a risk of insufficient mixing between the air having passed through the first holes 111 and the air having passed through the second hole 112 as described above.

Therefore, with the configuration where the center C2 of the at least one second hole 112 is within the above-described range, it is possible to promote mixing of the air having passed through the first holes 111 and the air having passed through the second hole 112 as described above, suppressing an unbalanced air flow in the combustor 4.

For example, the hole diameter of the at least one second hole 112 may be 2.0 times or more and 3.0 times or less the hole diameter of the first hole 111.

If the hole diameter of the second hole 112 is less than 2.0 times the hole diameter of the first hole 111, the difference between the hole diameter of the second hole 112 and the hole diameter of the first hole 111 is small, and there is a risk of insufficient mixing between the air having passed through the first holes 111 and the air having passed through the second hole 112 as described above.

Further, if the hole diameter of the second hole 112 is more than 3.0 times the hole diameter of the first hole 111, the difference in flow velocity (difference in pressure) between the air having passed through the first holes 111 and the air having passed through the second hole 112 further increases, and the pressure drop due to the generated secondary flow increases to such an extent that the effect of this pressure drop cannot be ignored.

Therefore, with the configuration where the hole diameter of the at least one second hole 112 is 2.0 times or more and 3.0 times or less the hole diameter of the first hole 111, it is possible to promote mixing of the air having passed through the first holes 111 and the air having passed through the second hole 112 as described above, while suppressing the effect of pressure drop due to the secondary flow.

Figure 12:
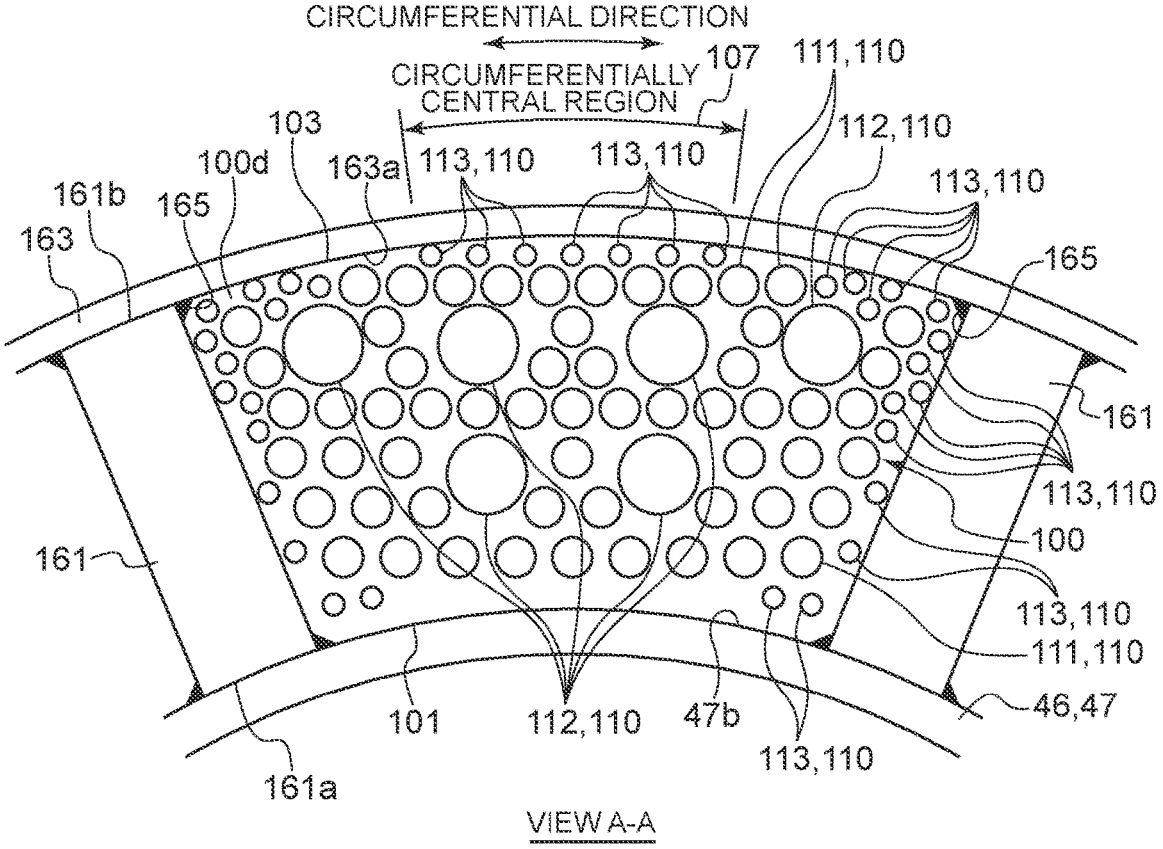
FIG. 12 is a diagram showing an example of another embodiment of the size of holes.

FIG. 12 is a diagram showing an example of another embodiment of the size of holes 110.

Figure 13:
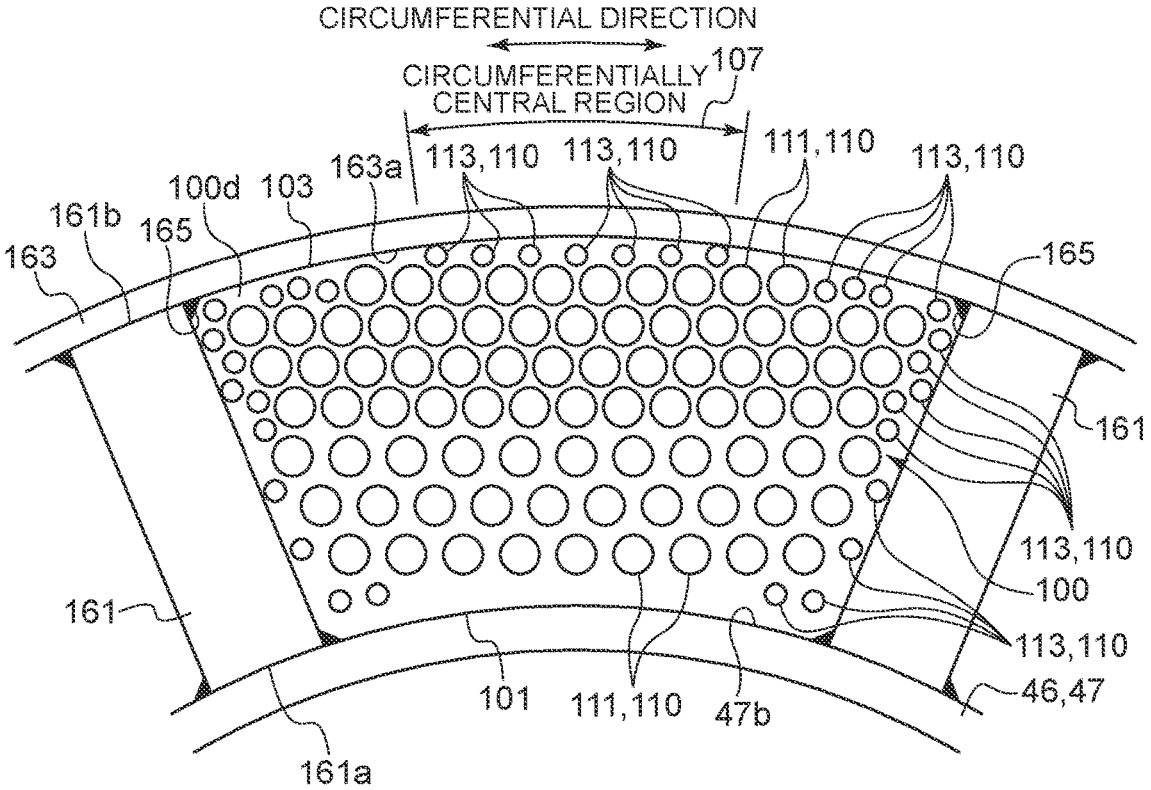
FIG. 13 is a diagram showing an example of another embodiment of the size of holes.

FIG. 13 is a diagram showing an example of another embodiment of the size of holes 110.

In the perforated plate 100 according to some embodiments, for example, as shown in FIG. 12, the plurality of holes 110 may include a plurality of first holes 111, at least one second hole 112 having a larger opening area than that of each first hole 111, and at least one third hole 113 having a smaller opening area than that of each first hole 111.

In the perforated plate 100 according to some embodiments, for example, as shown in FIG. 13, the plurality of holes 110 may include a plurality of first holes 111, and at least one third hole 113 having a smaller opening area than that of each first hole 111.

The hole diameter of the third hole may be, for example, 0.3 times or more and 0.8 times or less the hole diameter of the first hole.

For example, as shown in FIG. 12, the third hole 113 may be provided in a region of the perforated plate 100 shown in FIG. 11 where the first holes 111 and the second holes 112 do not exist. For example, as shown in FIG. 13, the third hole 113 may be provided in a region of the perforated plate 100 shown in FIG. 6 where the first holes 111 do not exist. With this configuration, the opening area in the perforated plate 100 can be increased, and the flow rate of the compressed air passing through the perforated plate 100 can be increased.

Even if one of the two adjacent holes 110 is the first hole 111 and the other is the third hole 113, there may be a radial distribution in which the ligament ratio of these two holes 111 and 113 increases from the radially outer side to the radially inner side.

Similarly, even if one of the two adjacent holes 110 is the second hole 112 and the other is the third hole 113, there may be a radial distribution in which the ligament ratio of these two holes 112 and 113 increases from the radially outer side to the radially inner side.

The combustor 4 according to some embodiments is provided with the perforated plate 100 according to any one of the above-described embodiments. Thereby, it is possible to achieve the combustor 4 with improved durability of the perforated plate 100 while ensuring the amount of air passing through the perforated plate 100.

The gas turbine 1 according to some embodiments is provided with the above-described combustor 4. Thereby, it is possible to improve the reliability of the gas turbine 1.

The present disclosure is not limited to the embodiments described above, but includes modifications to the embodiments described above, and embodiments composed of combinations of those embodiments.

For example, the holes 110 according to the above-described embodiments may be arranged in the circumferential direction with respect to the central axis AX of the combustor basket 47, or may be arranged at random.

The contents described in the above embodiments would be understood as follows, for instance.

(1) A perforated plate 100 for a gas turbine combustor 4 according to at least one embodiment of the present disclosure is a perforated plate 100 provided between a combustor basket 47 and a combustor casing 45 of the gas turbine combustor 4 and fixed to an outer peripheral portion of the combustor basket 47. In a hole arrangement area 105 with a plurality of through holes (holes 110) of the perforated plate 100, a region close to the combustor basket 47 (inner region 108*a*) has a larger average value of a ligament ratio than a region close to the combustor casing 45 (outer region 108*b*), where the ligament ratio is obtained by dividing a distance P2 between outer peripheral edges 109 of two adjacent holes 110 of the plurality of through holes (holes 110) by a distance P1 between the centers of the two holes 110.

With the above configuration (1), in the hole arrangement area 105, the proportion of the area of the region without the holes 110 per unit area in the perforated plate 100 is larger in the region close to the combustor basket 47 (inner region 108*a*) than in the region close to the combustor casing 45 (outer region 108*b*), so that the strength of the perforated plate 100 is improved. As a result, the stress on the perforated plate 100, which tends to increase from the radially outer side to the radially inner side as described above, can be effectively alleviated while suppressing the effect on the aperture ratio of the holes 110.

(2) In some embodiments, in the above configuration (1), the perforated plate 100 may have a radial distribution in which the ligament ratio increases from the radially outer side to the radially inner side at least in a partial region of the hole arrangement area 105.

With the above configuration (2), at least in the partial region of the hole arrangement area 105, the proportion of the area of the region without the holes 110 per unit area in the perforated plate 100 increases from the radially outer side to the radially inner side, so that the strength of the perforated plate 100 is improved. As a result, the stress on the perforated plate 100, which tends to increase from the radially outer side to the radially inner side as described above, can be effectively alleviated while suppressing the effect on the aperture ratio of the holes 110.

(3) In some embodiments, in the above configuration (2), the perforated plate 100 has a plurality of radially extending support members (ribs 161) arranged in the circumferential direction. The hole arrangement area 105 is a partially annular region partitioned in the circumferential direction by adjacent support members (ribs 161). The perforated plate 100 may have the above-described radial distribution in a circumferentially central portion of the partially annular region as the partial region.

With the above configuration (3), at least in the circumferentially central portion of the hole arrangement area 105, the proportion of the area of the region without the holes 110 per unit area in the perforated plate 100 increases from the radially outer side to the radially inner side, so that the strength of the perforated plate 100 is improved. As a result, the stress on the perforated plate 100, which tends to increase from the radially outer side to the radially inner side as described above, can be effectively alleviated while suppressing the effect on the aperture ratio of the holes 110.

(4) In some embodiments, in the above configuration (2) or (3), in the perforated plate 100, a circumferential ligament ratio which is an average value of the ligament ratio in the circumferential direction may increase from the radially outer side to the radially inner side at least in a partial region of the hole arrangement area 105.

With the above configuration (4), the area of the region without the holes 110 increases from the radially outer side to the radially inner side in the partial region, so that the strength of the perforated plate 100 is improved.

(5) In some embodiments, in any one of the above configurations (2) to (4), in the above-described radial distribution, a second ratio may be larger than a first ratio, where the first ratio is a ratio ($\Delta r/\Delta d$) of change $\Delta r$ in ligament ratio to change $\Delta d$ in radial position in a first radial range R1, and the second ratio is a ratio (Δr/Δd) of change Δr in ligament ratio to change Δd in radial position in a second radial range R2 that is radially inward of the first radial range R1.

With the above configuration (5), the ratio (Δr/Δd) is larger in a relatively radially inner region than in a relatively radially outer region. Thus, the strength of the perforated plate 100 can be improved in the relatively radially inner region while ensuring the aperture ratio and thus the flow rate of air passing through the plurality of holes 110 in the relatively radially outer region.

(6) In some embodiments, in the above configuration (5), in the above-described radial distribution, the ratio (Δr/Δd) may gradually increase from the radially outer side to the radially inner side.

With the above configuration (6), the ratio (Δr/Δd) increases toward the radially inner side. Thus, the strength of the perforated plate 100 can be improved in the relatively radially inner region while ensuring the aperture ratio and thus the flow rate of air passing through the plurality of holes 110 in the relatively radially outer region.

(7) In some embodiments, in any one of the above configurations (1) to (6), the aperture ratio of the plurality of through holes (holes 110) in the hole arrangement area 105 may be 45% or more and 70% or less.

If the aperture ratio is less than 45%, it may be difficult to ensure the flow rate of air passing through the plurality of holes 110, that is, the amount of air required in the combustor 4. Further, if the aperture ratio is more than 70%, the strength of the perforated plate 100 may be impaired.

With the above configuration (7), the strength of the perforated plate 100 can be ensured while ensuring the flow rate of air passing through the plurality of holes 110.

(8) In some embodiments, in any one of the above configurations (1) to (7), the plurality of through holes (holes 110) may have a pair of holes 110 that are arranged adjacent to each other in the circumferential direction at different radial positions.

With the above configuration (8), the arrangement density of the holes 110 can be relatively increased, so that the flow rate of air passing through the plurality of holes 110 can be ensured.

(9) In some embodiments, in any one of the above configurations (1) to (8), the plurality of through holes (holes 110) may include a plurality of first holes 111, and at least one second hole 112 having a larger opening area than that of each first hole 111. The centers C1 of at least some of the plurality of first holes 111 may be located radially outward and radially inward of an opening edge (outer peripheral edge 109) of the second hole 112 and within a circumferential range 141 of the outer peripheral edge (outer peripheral edge 109) of the second hole 112.

Generally, airflow having passed through a hole with a relatively small opening area is more likely to maintain velocity in a radially central region of the airflow than airflow having passed through a hole with a relatively large opening area. With the above configuration (9), since the first holes 111 having a smaller opening area than that of the second hole 112 are arranged radially outward and radially inward of the second hole 112, the difference in velocity (difference in pressure) between the air having passed through the first holes 111 and the air having passed through the second hole 112 increases, and a secondary flow is generated. This promotes mixing of the air having passed through the first holes 111 and the air having passed through the second hole 112, suppressing an unbalanced air flow in the combustor 4.

(10) In some embodiments, in the above configuration (9), when the radial position of the radially inner end portion 105*a* of the hole arrangement area 105 is 0% and the radial position of the radially outer end portion 105*b* of the hole arrangement area 105 is 100%, the radial position of the center C2 of the at least one second hole 112 may be within the range of 25% or more and 75% or less.

If the radial position of the center C2 of the at least one second hole 112 is out of this range, there is a risk of insufficient mixing between the air having passed through the first holes 111 and the air having passed through the second hole 112 as described above.

With the above configuration (10), it is possible to promote mixing of the air having passed through the first holes 111 and the air having passed through the second hole 112 as described above, suppressing an unbalanced air flow in the combustor 4.

(11) In some embodiments, in the above configuration (9) or (10), the hole diameter of the at least one second hole 112 may be 2.0 times or more and 3.0 times or less the hole diameter of the first hole 111.

If the hole diameter of the second hole 112 is less than 2.0 times the hole diameter of the first hole 111, the difference between the hole diameter of the second hole 112 and the hole diameter of the first hole 111 is small, and there is a risk of insufficient mixing between the air having passed through the first holes 111 and the air having passed through the second hole 112 as described above.

Further, if the hole diameter of the second hole 112 is more than 3.0 times the hole diameter of the first hole 111, the difference in flow velocity (difference in pressure) between the air having passed through the first holes 111 and the air having passed through the second hole 112 further increases, and the pressure drop due to the generated secondary flow increases to such an extent that the effect of this pressure drop cannot be ignored.

With the above configuration (11), it is possible to promote mixing of the air having passed through the first holes 111 and the air having passed through the second hole 112 as described above, while suppressing the effect of pressure drop due to the secondary flow.

(12) A gas turbine combustor 4 according to at least one embodiment of the present disclosure is provided with the perforated plate 100 having any one of the above configurations (1) to (11).

With the above configuration (12), it is possible to achieve the gas turbine combustor 4 with improved durability of the perforated plate 100 while ensuring the amount of air passing through the perforated plate 100.

(13) A gas turbine 1 according to at least one embodiment of the present disclosure is provided with the gas turbine combustor 4 having the above configuration (12).

With the above configuration (13), it is possible to improve the reliability of the gas turbine 1.

REFERENCE SIGNS LIST

1 Gas turbine
4 Gas turbine combustor (Combustor)
43 Air passage
45 Combustor casing
46 Combustion liner

47 Combustor basket
100 Flow conditioning plate (Perforated plate)
105 Hole arrangement area
107 Circumferentially central region
110 Through hole (Hole)
111 First hole
112 Second hole
113 Third hole

The invention claimed is:

1. A perforated plate for a gas turbine combustor, provided between a combustor basket and a combustor casing of the gas turbine combustor and fixed to an outer peripheral portion of the combustor basket, wherein, in a hole arrangement area with a plurality of through holes of the perforated plate, a region close to the combustor basket has a larger average value of a ligament ratio than a region close to the combustor casing, where the ligament ratio is obtained by dividing a distance between outer peripheral edges of two adjacent holes of the plurality of through holes by a distance between centers of the two holes, wherein the perforated plate has a radial distribution in which the ligament ratio increases from a radially outer side to a radially inner side at least in a partial region of the hole arrangement area, and wherein, in the radial distribution, a second ratio is larger than a first ratio, where the first ratio is a ratio of change in the ligament ratio to change in radial position in a first radial range, and the second ratio is a ratio of change in the ligament ratio to change in radial position in a second radial range that is radially inward of the first radial range.

2. The perforated plate for a gas turbine combustor according to claim 1, wherein the perforated plate has a plurality of radially extending support members arranged in a circumferential direction, wherein the hole arrangement area is a partially annular region partitioned in the circumferential direction by adjacent support members of the plurality of support members, and wherein the perforated plate has the radial distribution in a circumferentially central portion of the partially annular region as the partial region.

3. The perforated plate for a gas turbine combustor according to claim 1, wherein, in the perforated plate, a circumferential ligament ratio which is an average value of the ligament ratio in the circumferential direction increases from the radially outer side to the radially inner side at least in the partial region.

4. The perforated plate for a gas turbine combustor according to claim 1, wherein, in the radial distribution, the ratio gradually increases from the radially outer side to the radially inner side.

5. The perforated plate for a gas turbine combustor according to claim 1, wherein the plurality of through holes has a pair of holes that are arranged adjacent to each other in a circumferential direction at different radial positions.

6. A gas turbine combustor, comprising the perforated plate according to claim 1.

7. A gas turbine, comprising the gas turbine combustor according to claim 6.

8. A perforated plate for a gas turbine combustor, provided between a combustor basket and a combustor casing of the gas turbine combustor and fixed to an outer peripheral portion of the combustor basket, wherein, in a hole arrangement area with a plurality of through holes of the perforated plate, a region close to the combustor basket has a larger average value of a ligament ratio than a region close to the combustor casing, where the ligament ratio is obtained by dividing a distance between outer peripheral edges of two adjacent holes of the plurality of through holes by a distance between centers of the two holes, and wherein an aperture ratio of the plurality of through holes in the hole arrangement area is 45% or more and 70% or less.

9. A perforated plate for a gas turbine combustor, provided between a combustor basket and a combustor casing of the gas turbine combustor and fixed to an outer peripheral portion of the combustor basket, wherein, in a hole arrangement area with a plurality of through holes of the perforated plate, a region close to the combustor basket has a larger average value of a ligament ratio than a region close to the combustor casing, where the ligament ratio is obtained by dividing a distance between outer peripheral edges of two adjacent holes of the plurality of through holes by a distance between centers of the two holes, wherein the plurality of through holes includes a plurality of first holes and at least one second hole having a larger opening area than that of each first hole, and wherein the centers of at least some of the plurality of first holes are located radially outward and radially inward of an opening edge of the second hole and within a circumferential range of the opening edge of the second hole.

10. The perforated plate for a gas turbine combustor according to claim 9, wherein a radial position of the center of the least one second hole is within a range of 25% or more and 75% or less when the radial position of a radially inner end portion of the hole arrangement area is 0% and the radial position of a radially outer end portion of the hole arrangement area is 100%.

11. The perforated plate for a gas turbine combustor according to claim 9, wherein a hole diameter of the at least one second hole is 2.0 times or more and 3.0 times or less a hole diameter of each first hole.

* * * * *